US011490709B2

(12) United States Patent
Lee et al.

(10) Patent No.: US 11,490,709 B2
(45) Date of Patent: Nov. 8, 2022

(54) COSMETIC CONTAINER

(71) Applicant: SAMHWA CO., LTD, Uiwang-si (KR)

(72) Inventors: Kyungchang Lee, Uiwang-si (KR); Sikyu Choi, Ansan-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 0 days.

(21) Appl. No.: 17/369,889

(22) Filed: Jul. 7, 2021

(65) Prior Publication Data

US 2022/0192344 A1 Jun. 23, 2022

(30) Foreign Application Priority Data

Dec. 23, 2020 (KR) ..... 10-2020-0182049

(51) Int. Cl.
*A45D 34/04* (2006.01)
*B05B 11/00* (2006.01)

(52) U.S. Cl.
CPC ..... *A45D 34/04* (2013.01); *B05B 11/3045* (2013.01); *A45D 2200/055* (2013.01); *A45D 2200/057* (2013.01)

(58) Field of Classification Search
CPC ..... A45D 34/04; A45D 2200/055; A45D 2200/057; B05B 11/3045; B05B 11/3047; B05B 11/3014; B05B 11/12; B05B 11/3011; B05B 11/3001; B05B 11/30; B05B 11/0005; B05B 11/00
USPC ..... 222/321.7
See application file for complete search history.

(56) References Cited

U.S. PATENT DOCUMENTS

| | | | | |
|---|---|---|---|---|
| 5,620,113 | A | 4/1997 | Meshberg | |
| 5,642,908 | A * | 7/1997 | Mascitelli | B05B 11/3049 222/321.9 |
| 6,073,805 | A | 6/2000 | Gueret | |
| 6,463,650 | B1 * | 10/2002 | Bougamont | B05B 11/3049 222/321.7 |
| 6,641,001 | B2 * | 11/2003 | Beranger | B65D 83/38 222/402.1 |
| 2007/0068593 | A1 | 3/2007 | Behar et al. | |
| 2021/0196025 | A1 * | 7/2021 | Daviot | B05B 11/3074 |

FOREIGN PATENT DOCUMENTS

| | | | |
|---|---|---|---|
| KR | 10-1963619 | B1 | 3/2019 |
| KR | 10-1975847 | B1 | 5/2019 |

* cited by examiner

*Primary Examiner* — Vishal Pancholi
*Assistant Examiner* — Robert K Nichols, II
(74) *Attorney, Agent, or Firm* — Park, Kim & Suh, LLC

(57) ABSTRACT

A cosmetic container is disclosed. One aspect of the invention provides a cosmetic container that includes: a body in which an interior space is formed for holding a content; a body shoulder coupled to an upper part of the body; and a pump coupled to an upper part of the body shoulder, where the body shoulder includes an outer periphery member inserted into the body, an inner periphery member positioned on the inside of the outer periphery member, a placement step formed on an upper part of the inner periphery member, and a pump support protruding downward from the placement step and having the pump inserted through an inside thereof, and where the pump includes a housing inserted through the pump support, and a housing flange configured to rest on the placement step is formed on an outer perimeter of the housing.

13 Claims, 11 Drawing Sheets

COSMETIC CONTAINER

CROSS-REFERENCE TO RELATED APPLICATIONS

This application claims the benefit of Korean Patent Application No. 10-2020-0182049, filed with the Korean Intellectual Property Office on Dec. 23, 2020, the disclosure of which is incorporated herein by reference in its entirety.

BACKGROUND

1. Technical Field

The present invention relates to a cosmetic container that has a simple composition and is easy to recycle.

2. Description of the Related Art

In a cosmetic container and the like, a pump is coupled to the opening at the upper part of a container holding a liquid content such as a cosmetic, etc., to dispense and spray the content to the exterior in designated amounts. When the user presses down on a nozzle corresponding to a button so as to spray the liquid content, the content that had been supplied within the cosmetic container is pressurized, moved upward along the discharge passage, and sprayed through the nozzle. When the pressure on the nozzle is released, the discharge passage is mechanically closed by the rising of the nozzle, the pressure inside the pump is decreased, and the content is drawn in from the container to compensate.

A cosmetic container equipped with a pump such as the above is being used not only for spraying perfumes and cosmetics but also a variety of other contents such as shampoos, air fresheners, insecticides, etc. Due to the convenience of dispensing designated amounts of a content with a single pressing of the nozzle without having the content exposed to outside air, use of such container continues to grow.

A cosmetic container equipped with a spray pump is disclosed in Korean Registered Patent No. 1963619. The cosmetic container disclosed in the prior art document includes a nozzle, nozzle cap, cap cover, cap, valve, valve spring, housing cover, piston spring, piston, guide, disk, and housing, among others, and hence has a complicated structure that is difficult to fabricate. Also, the conventional cosmetic container may include a valve spring and a piston spring, which may be made of a metallic material, differing in material from the other parts made of plastic and making it difficult to recycle the container. Recent interest in and awareness of the need for environment friendliness has increased the demand for cosmetic containers that are easy to recycle, but the conventional cosmetic container fails to meet such demand.

Moreover, the spray pump disclosed in the prior art document above entails a complicated structure and shape for coupling with the container storing the content, where such complexity may be a cause of increased fabrication time and costs.

SUMMARY OF THE INVENTION

Therefore, an aspect of the invention, which was conceived to resolve the problems above, is to provide a cosmetic container that has a simple structure and is easy to recycle.

Other objectives of the present invention will be more clearly understood from the embodiments set forth below.

One aspect of the invention provides a cosmetic container that includes: a body in which an interior space is formed for holding a content; a body shoulder coupled to an upper part of the body; and a pump coupled to an upper part of the body shoulder, where the body shoulder includes an outer periphery member, which may be inserted into the body, an inner periphery member, which may be positioned on the inside of the outer periphery member, a placement step, which may be formed on an upper part of the inner periphery member, and a pump support, which may protrude downward from the placement step and through the inside of which the pump may be inserted, and where the pump includes a housing inserted through the pump support, and a housing flange configured to rest on the placement step is formed on an outer perimeter of the housing.

A cosmetic container according to an embodiment of the present invention can include one or more of the following features. For example, an outer step in which an upper end of the body may be inserted can be formed on the outer periphery member, and a detent protrusion through which an outer perimeter of the housing may be inserted can be formed on an inner perimeter of the pump support. A disconnect portion can be formed in the detent protrusion.

The body shoulder can include a bottom surface, a reinforcing member can protrude from the bottom surface, and the reinforcing member can be connected with the inner periphery member.

A disconnect portion can be formed between the reinforcing member and the inner perimeter of the outer periphery member.

A gap can be formed between the inner periphery member and the pump support.

The outer periphery member can include an inner step formed on its inner perimeter, and the inner step can have a downwardly inclining sloped surface.

An embodiment of the present invention having the features above can provide various advantageous effects including the following. However, an embodiment of the present invention may not necessarily exhibit all of the effects below.

An embodiment of the invention can provide a cosmetic container that has a simple structure and is easy to recycle.

DETAILED DESCRIPTION OF THE INVENTION

Figure 1:
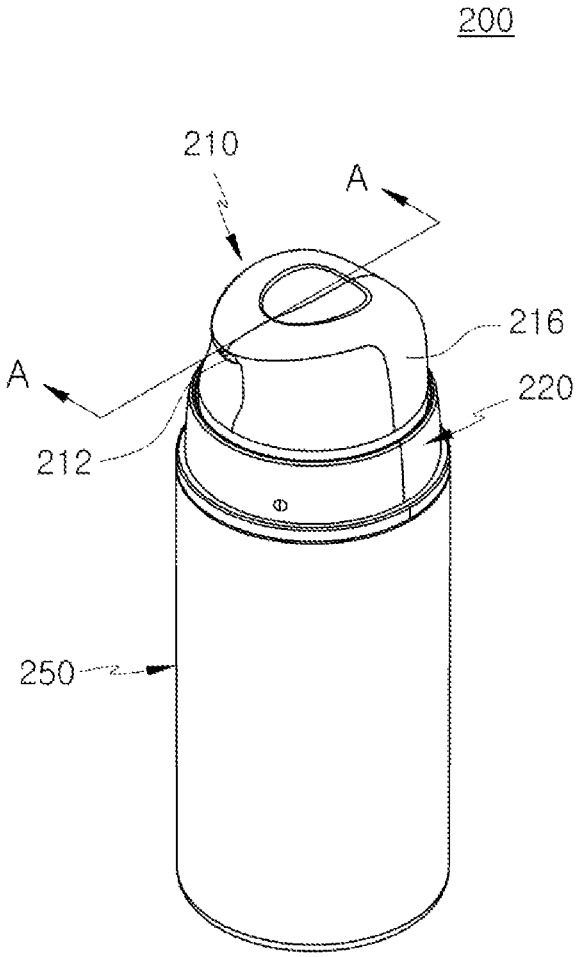
FIG. 1 is a perspective view illustrating a cosmetic container according to a first disclosed embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

Figure 2:
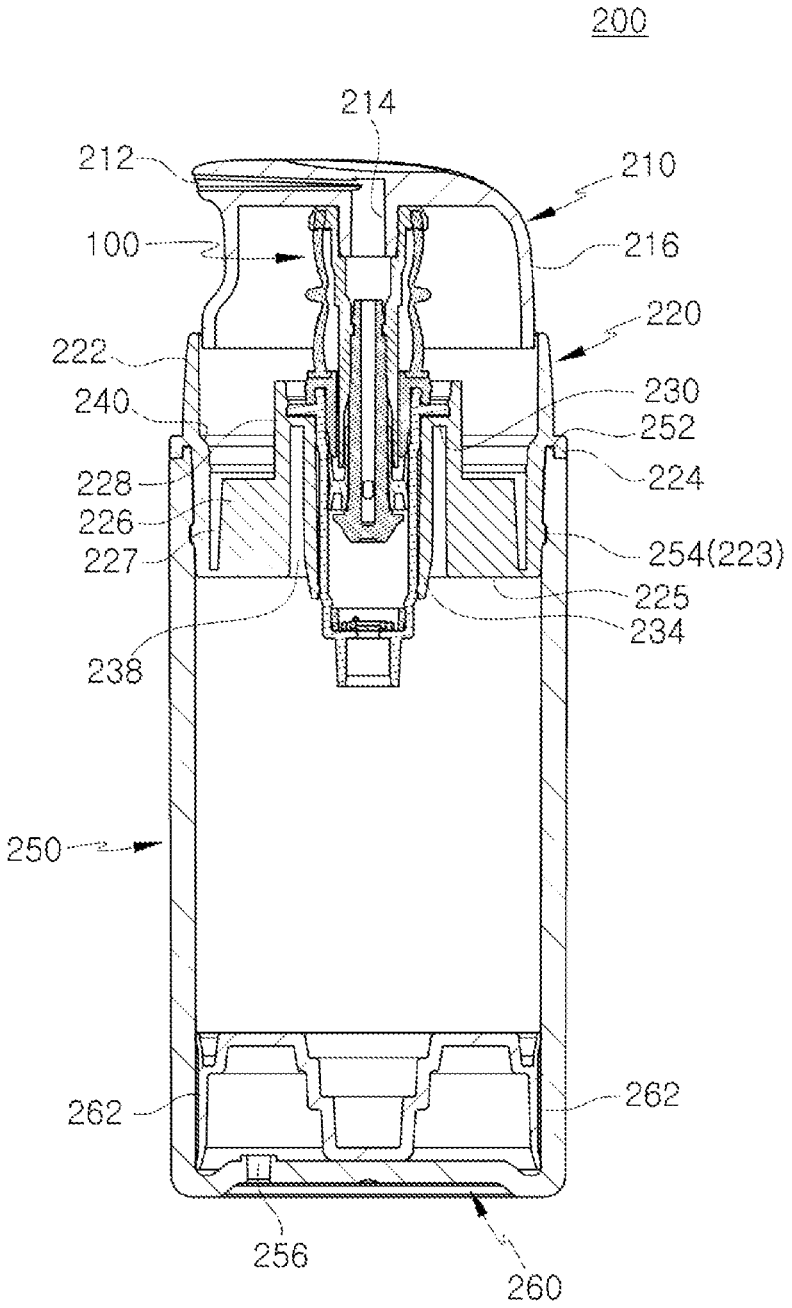
FIG. 2 is a cross-sectional view across line A-A of FIG. 1.
Figure 3:
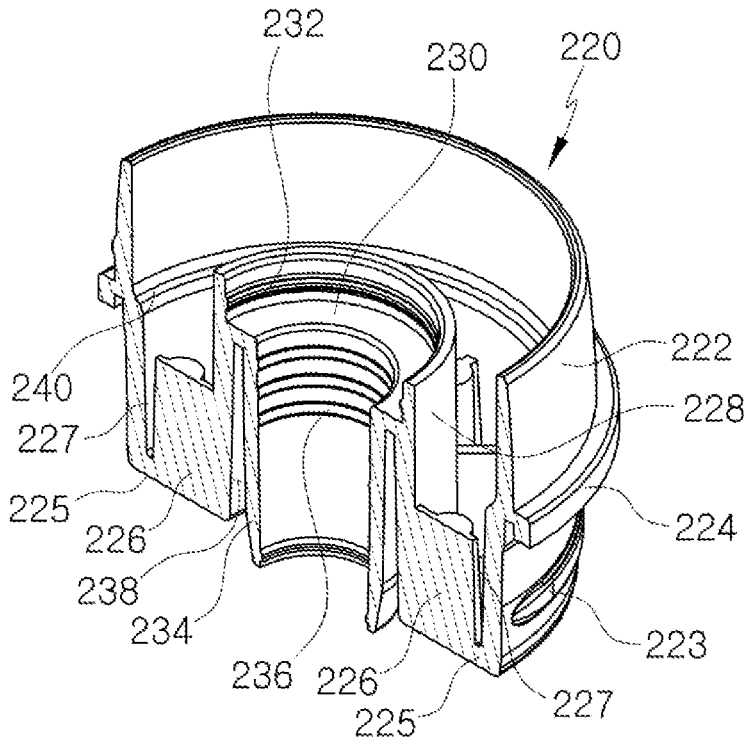
FIG. 3 and FIG. 4 are a perspective cross-sectional view and a perspective view of the body shoulder of the cosmetic container illustrated in FIG. 1.
Figure 4:
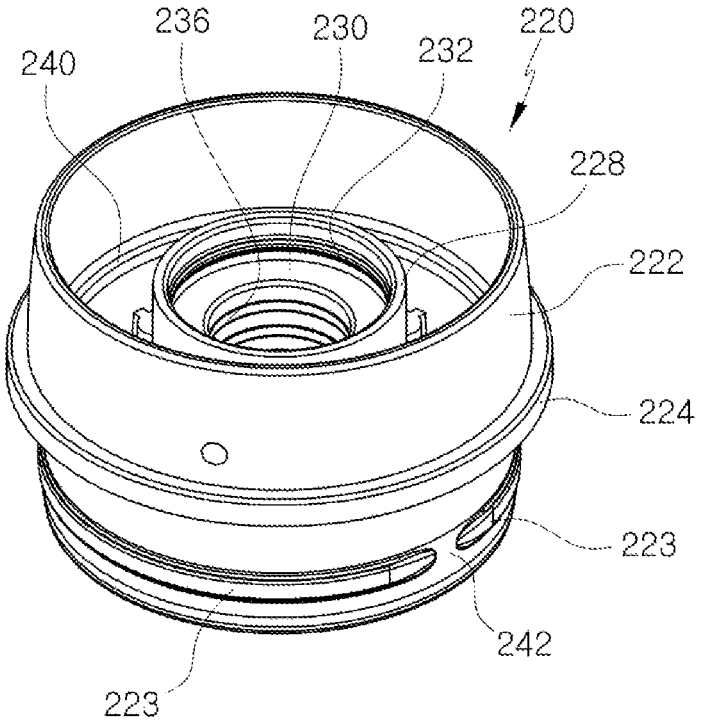

FIG. 1 is a perspective view illustrating a cosmetic container 200 according to a first disclosed embodiment of the invention, and FIG. 2 is a cross-sectional view across line A-A of FIG. 1. FIG. 3 is a perspective cross-sectional view of the body shoulder 220 of the cosmetic container 200 illustrated in FIG. 1, and FIG. 4 is a perspective view of the body shoulder 220.

Referring to FIGS. 1 to 4, a cosmetic container 200 according to this embodiment may be equipped with a nozzle 210 at the top such that pressing the nozzle 210 operates the pump 100 inside and causes the content stored in the body 250 to be discharged. A cosmetic container 200 according to this embodiment may include a nozzle 210, a body shoulder 220, a body 250, a body piston 260, and a pump 100.

The nozzle 210 may be positioned at an upper part of the body 250 and may be pressed by the user. The nozzle 210 may have the shape of a hollow cylinder with an open bottom. The nozzle 210 may include a periphery member 216, where the periphery member 216 can have a circular horizontal cross section and can be inserted into the inside of the body shoulder 220.

The nozzle 210 may include a discharge hole 212, where the discharge hole 212 may be connected with the pump 100. Thus, the content (not shown) moved through the pump 100 can be discharged through the discharge hole 212 to the exterior of the nozzle 210.

Within the nozzle 210, a coupler protrusion 214 protrude downwards. The coupler protrusion 214 may be shaped as a hollow column and may be inserted into the upper end of a valve 110 of the pump 100. As a result, the nozzle 210 and the valve 110 may move up and down as an integrated body, and the content that has passed through the valve 110 may move through the coupler protrusion 214 to the discharge hole 212.

The body shoulder 220 may be coupled to an upper end of the body 250 and may have the pump 100 coupled therein. The body shoulder 220 may allow the pump 100, which has a smaller diameter compared to the body 250, to be easily coupled to the upper part of the body 250.

The body shoulder 220 may include an outer periphery member 222 having a circular horizontal cross section, where the outer diameter of the outer periphery member 222 can be the same or almost the same as the inner diameter of the body 250. Thus, the outer periphery member 222 may be inserted into the upper end of the body 250. An outer step 224 can be formed on the outer periphery member 222, where the outer step 224 may be inserted into a shoulder coupler groove 254 formed in the inner perimeter of the body 250. Such a coupling between the outer step 224 and the shoulder coupler groove 254 may allow the body shoulder 220 to be firmly coupled to the upper part of the body 250.

An inner periphery member 228 may be provided on the inside of the outer periphery member 222, and a multiple number of reinforcing members 226 may be provided between the outer periphery member 222 and the inner periphery member 228. The reinforcing members 226 may protrude upward from the bottom surface 225 of the body shoulder 220 and may be connected to the inner periphery member 228. Thus, the inner periphery member 228 protruding upward from the bottom surface 225 may be made structurally stable by the reinforcing members 226.

The reinforcing members 226 can be formed in a multiple number in particular intervals and can be formed with a height that is lower than that of the inner periphery member 228.

Disconnect portions 227 may be formed between the reinforcing members 226 and the outer periphery member 222. Because of the disconnect portions 227, the reinforcing members 226 and the outer periphery member 222 may not be connected. When the outer periphery member 222 is inserted into the upper end of the body 250, the disconnect portions 227 can allow the outer periphery member 222 to easily undergo an elastic deformation, whereby the outer periphery member 222 can be firmly secured to the inner perimeter at the upper part of the body 250 to prevent the content from leaking.

Due to the presence of the bottom surface 225, the body shoulder 220 may be structured to be penetrated only at the pump support 234, corresponding to the center.

On the inner perimeter of the outer periphery member 222, there may be formed an inner step 240. Due to the inner step 240, the diameter at the inner perimeter of the outer periphery member 222 may be decreased. Also, the inner step 240 may have a downwardly inclining sloped surface. When the nozzle 210 is pressed down, the lower end of the nozzle 210 can touch the inner step 240, whereby further downward movement of the nozzle 210 may be limited.

The inner periphery member 228 may correspond to a hollow cylinder that is formed in the center on the inside of the outer periphery member 222 and may be structured to have both the upper end and the lower end open. An annularly shaped placement step 230 may be provided on an upper part of the inner periphery member 228. A housing flange 152 of the pump 100 may rest and be positioned on the placement step 230. Also, on the inner perimeter of the inner periphery member 228, there may be provided an inwardly protruding detent protrusion 232. The housing flange 152 may pass over and be caught on a lower part of the detent protrusion 232, so that the housing 150 can be firmly secured within the inner periphery member 228.

The pump support 234, which may be shaped as a hollow cylinder, may be provided on the inside of the inner periphery member 228. The pump support 234 may protrude vertically downward from the end portion of the placement step 230 and may be structured to have the shape of a hollow cylinder with both the upper end and lower end open. The pump support 234 may have the housing 150 of the pump 100 inserted therein.

A detent protrusion 236 may be provided also on the inner perimeter of the pump support 234. A multiple number of detent protrusions 236 can be formed along the longitudinal direction on the inner perimeter of the pump support 234, and FIG. 3 illustrates an example in which there are three detent protrusions 236 at the upper part and one detent protrusion 236 at the lower part of the inner perimeter. The detent protrusions 236 may press against the outer perimeter of the housing 150 of the pump 100, so as to prevent the pump 100 from becoming easily detached from the pump support 234 and strengthen the sealing function.

A gap 238 may be formed between the pump support 234 and the inner periphery member 228. The gap 238 may allow the pump support 234 to be displaced in relation to the inner periphery member 228, so that a pressure applied on the pump 100 may displace only the pump support 234 and may leave the inner periphery member 228 and the outer periphery member 222 undisplaced. Thus, the inner periphery member 228 and the outer periphery member 222 can remain coupled to the upper part of the body 250 in a stable manner in spite of the operation of the pump 100.

The body 250 may include an interior space (no numeral assigned) in which the content is stored and may have the body shoulder 220 coupled to its upper end for coupling with the pump 100. The content that has been injected into the interior space may be moved through the pump 100 in the direction of the nozzle 210.

The body 250 may be structured to have the shape of a hollow cylinder with its upper part open. On the upper end of the body 250, there may be formed an upper protrusion 252, which may be inserted into the outer step 224 formed on the outer perimeter of the body shoulder 220.

A shoulder coupler groove 254 may be formed in the inner perimeter at an upper part of the body 250. The detent protrusion 223 formed on the outer perimeter of the body shoulder 220 may be inserted into the shoulder coupler groove 254, whereby the body shoulder 220 can be firmly secured to the upper end of the body 250.

A disconnect portion 242 having a disconnected shape may be formed in the detent protrusion 223. Depending on the detent protrusion 223, there can be one or multiple disconnect portions 242. The disconnect portion 242 may correspond to a passageway through which air within the body 250 can be discharged to the exterior during the fastening of the body shoulder 220 onto the body 250 that has been filled with the content.

The body 250 may have a bottom surface (no numeral assigned), and an air hole 256 may be formed in the bottom surface. Air can enter the lower part of the body 250 through the air hole 256, and the air that has entered may cause the body piston 260 to rise.

The body piston 260, which may be provided within the body 250, may rise when the content within the body 250 is discharged and thus reduced in amount, thereby allowing an easier discharging of the content. A contact member 262 may be provided around the periphery of the body piston 260, where the contact member 262 can move upward while maintaining tight contact against the inner perimeter of the body 250.

The nozzle 210, body shoulder 220, body 250 and body piston 260 of a cosmetic container 200 based on this embodiment can all be fabricated from the same type of plastic resin material, thereby providing the advantage that the manufacture and recycling of the cosmetic container 200 may be facilitated.

The pump 100 may be inserted into the pump support 234, corresponding to the center of the body shoulder 220, to discharge the content injected within the body 250. The housing 150 of the pump 100 may be inserted to the inside of the pump support 234 and may be secured coupled by the detent protrusions 232, 236. The housing flange 152 may be placed on the placement step 230 to secure the vertical position of the pump 100. Thus, a cosmetic container 200 based on this embodiment may provide the advantage of easy fabrication, since the coupling of the pump 100 may be completed simply by inserting the pump 100 into the pump support 234 corresponding to the center of the body shoulder 220.

Figure 5:
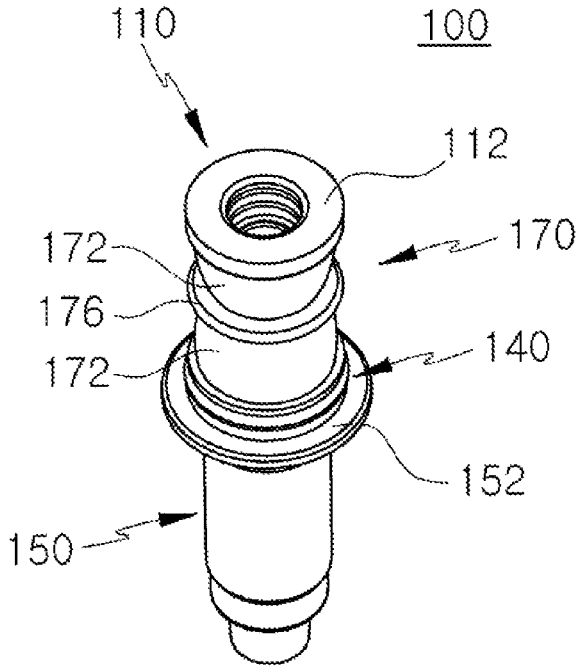
FIG. 5 is a perspective view illustrating the pump.
Figure 6:
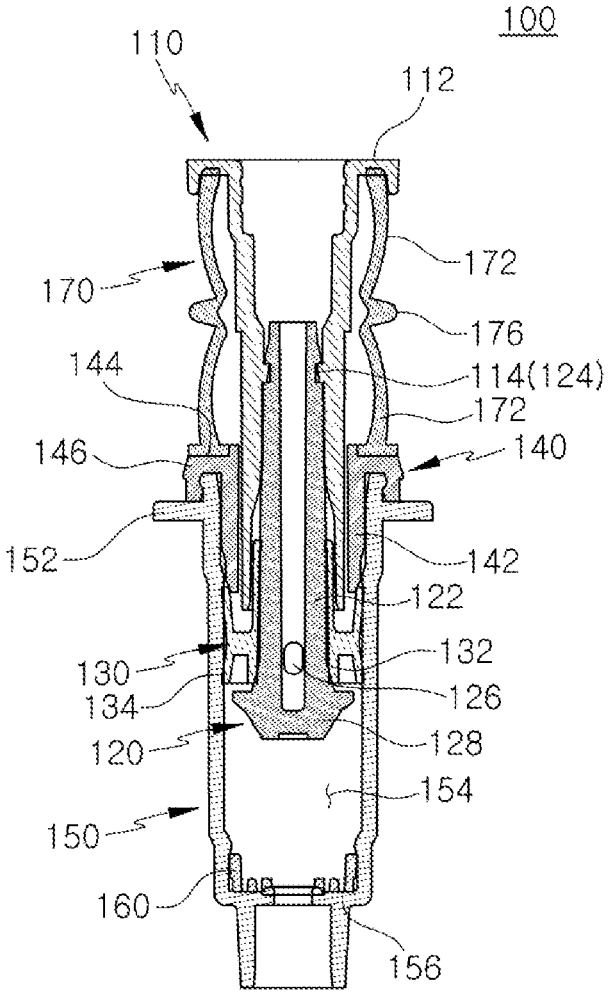
FIG. 6 is a vertical cross-sectional view across the center of the pump illustrated in FIG. 5.

FIG. 5 is a perspective view illustrating the pump 100, and FIG. 6 is a vertical cross-sectional view across the center of the pump 100 illustrated in FIG. 5.

Referring to FIG. 5 and FIG. 6, the pump 100 may use an elastic member 170 made from plastic resin or silicone, etc., in lieu of a conventional coil spring made from a metallic material. The elastic member 170 may have the shape of an hourglass with a tube-shaped center portion 176 protruding from the center, so as to be folded and elastically compressed when an external force is applied and be elastically restored to upwardly push the valve 110 and guide 120 when the external force is removed. As the elastic member 170 is formed from the same material as that of other components of the cosmetic container 200, it may be easier to recycle the cosmetic container 200.

Since the pump 100 includes the valve 110, guide 120, piston 130, pump shoulder 140, housing 150, disk 160, and elastic member 170, the composition is simpler compared to the conventional pump, allowing easier fabrication as well as decreased manufacturing cost.

Figure 7:
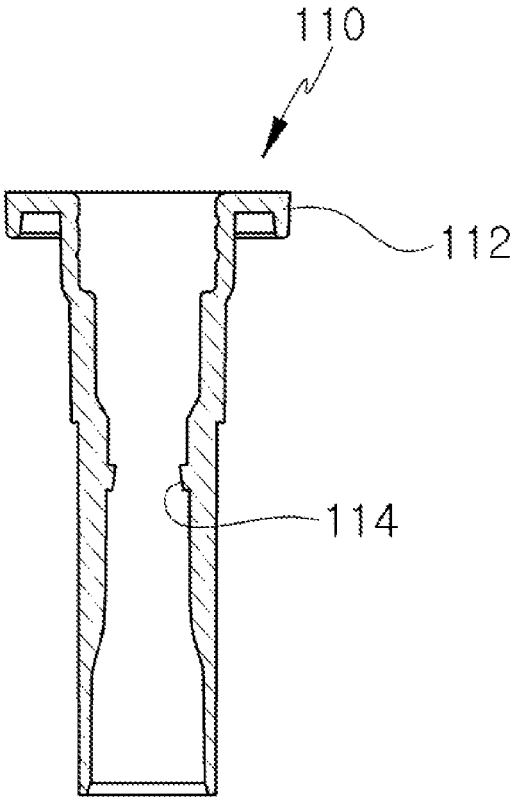
FIG. 7 is a vertical cross-sectional view across the center of the valve of the pump illustrated in FIG. 5.

FIG. 7 is a vertical cross-sectional view across the center of the valve 110 of the pump 100 based on an embodiment of the invention.

Referring to FIG. 6 and FIG. 7, the valve 110 may be structured to have the shape of a hollow cylinder with a valve flange 112 protruding outwards from the upper end thereof. The lower surface of the valve flange 112 may touch the upper end of the elastic member 170. A through-hole may be formed in the center of the valve 110. A button (not shown) of the pump may be coupled to an upper part of the valve 110, and a portion of the piston 130 and a portion of the guide 120 may be inserted into a lower part of the valve 110.

On the inner perimeter of the valve 110, there may be formed a coupler protrusion 114. The coupler protrusion 114 may be inserted into a coupler groove 124 formed in the periphery of the guide 120 inserted within the valve 110, so that the valve 110 and the guide 120 may move up or down together as an integrated body.

Figure 8:
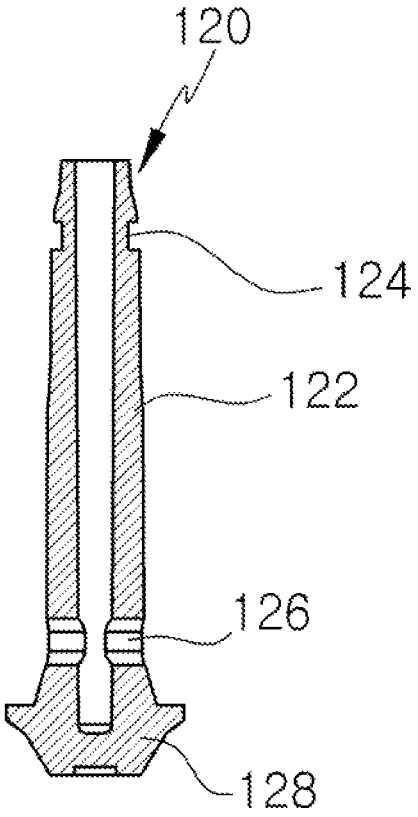
FIG. 8 is a vertical cross-sectional view across the center of the guide of the pump illustrated in FIG. 5.

FIG. 8 is a vertical cross-sectional view across the center of the guide 120 of the pump 100 based on an embodiment of the invention.

Referring to FIG. 6 and FIG. 8, the guide 120 may include a guide body 122, which may be inserted into the valve 110. The guide body 122 may have the shape of a hollow cylinder with its upper end open, connecting to the inside of the valve 110. Inlet holes 126 may be formed in the periphery of the guide body 122. The piston 130 can be put in tight contact around the inlet holes 126 and thus close the inlet holes 126.

At a lower end of the guide body 122, there may be formed a guide head 128. The guide head 128 may be a part that is formed with a larger diameter compared to the guide body 122 and may catch onto the lower part of the piston 130 when the guide 120 is moved upward such that the piston 130 is also moved upward together.

The piston 130 may tightly contact the outer perimeter of the guide body 122. The piston 130 may include a guide coupler portion 132 and a housing coupler portion 134.

The guide coupler portion 132 may tightly contact the outer perimeter of the guide body 122 and may have the shape of a hollow cylinder. The guide coupler portion 132 may close the inlet holes 126, and when the guide 120 is moved downward, the guide coupler portion 132 may move downward after a certain delay compared to the guide 120, to allow the inlet holes 126 to be open for a particular duration of time. The upper part of the guide coupler portion 132 may be inserted into the gap formed between the valve 110 and the guide 120.

The housing coupler portion 134 may have a larger diameter and a shorter length compared to the guide coupler portion 132 and may be disposed around the guide coupler portion 132. The housing coupler portion 134 may also have the shape of a hollow cylinder, and its outer perimeter may tightly contact the inner perimeter of the housing 150. Due to the housing coupler portion 134, the downward movement of the piston 130 may be delayed even as the guide 120 is moved downward.

Figure 10:
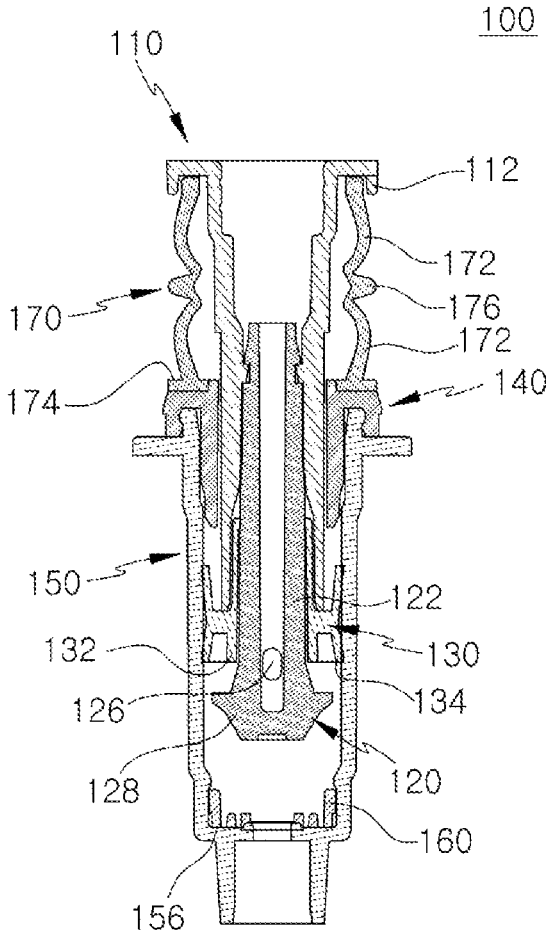
FIG. 10 is a cross-sectional view illustrating the guide opened by a pressing action from the state illustrated in FIG. 6.

FIG. 10 is a cross-sectional view across the center of the pump 100 after a downward pressing has compressed the elastic member 170 and opened the inlet holes 126 of the guide 120 from the state illustrated in FIG. 6.

Referring to FIG. 10, when the guide 120 is moved downward, the piston 130 may move downward with a certain delay due to friction with the inner perimeter of the housing 150. As a result, the inlet holes 126 of the guide 120 may be opened, and the content (not shown) that has entered the interior space 154 may be drawn in through the inlet holes 126 to the inside of the guide 120. When the guide 120 is moved upward, the piston 130 may be caught on the guide head 128 and be moved upward together with the guide 120.

Figure 9:
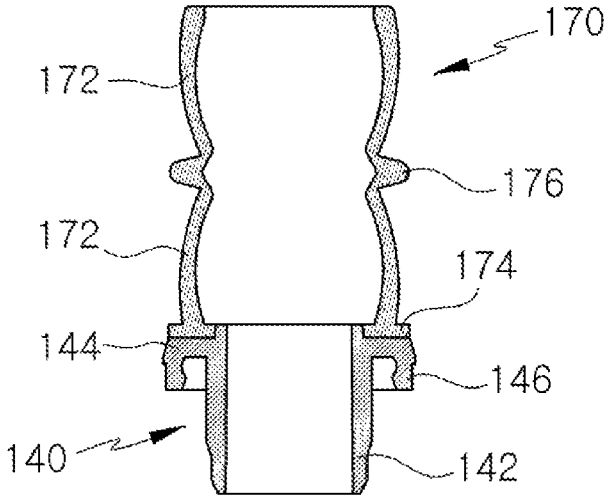
FIG. 9 is a vertical cross-sectional view across the center of the elastic member and the pump shoulder of the pump illustrated in FIG. 5.

FIG. 9 is a vertical cross-sectional view across the center of the pump shoulder 140 and elastic member 170 of the pump 100 based on an embodiment of the invention.

Referring to FIG. 6 and FIG. 9, the pump shoulder 140 may include a shoulder body 142 that is inserted into the open top of the housing 150. The shoulder body 142 may have the shape of a hollow cylinder and may have the valve 110 inserted therein. On the periphery of the shoulder body 142, a shoulder flange 144 may protrude outward. A placement ring 174 of the elastic member 170 may be positioned on the upper surface of the shoulder flange 144. Also, at the end portion of the shoulder flange 144, there may be formed a shoulder periphery member 146 protruding downward. The shoulder periphery member 146 may touch the outer perimeter of the upper part of the housing 150, and a lower end of the shoulder periphery member 146 may touch the upper surface of the housing flange 152.

The housing 150 may be coupled to the opening at the upper part of the body shoulder 220. The housing 150 may include an interior space 154 into which the content may be drawn, where the guide 120 and the piston 130 may be positioned and undergo upward and downward movements within the interior space 154.

The housing 150 may be structured to have the shape of a hollow cylinder with both its top and bottom open. The housing flange 152 may protrude outward from the periphery of the housing 150. The housing flange 152 can be placed on an upper part of the container (not shown).

On the inside of the housing 150, there may be formed a placement step 156, which may have a decreased diameter. The disk can be positioned on the placement step 156. The disk 160 may be opened or closed by a pressure difference between the interior space 154 and the container. As the structure of the disk 160 is as disclosed in documents such as Korean Registered Patent No. 1975847, etc., the structure of the disk 160 will not be described here in further detail.

Figure 11:
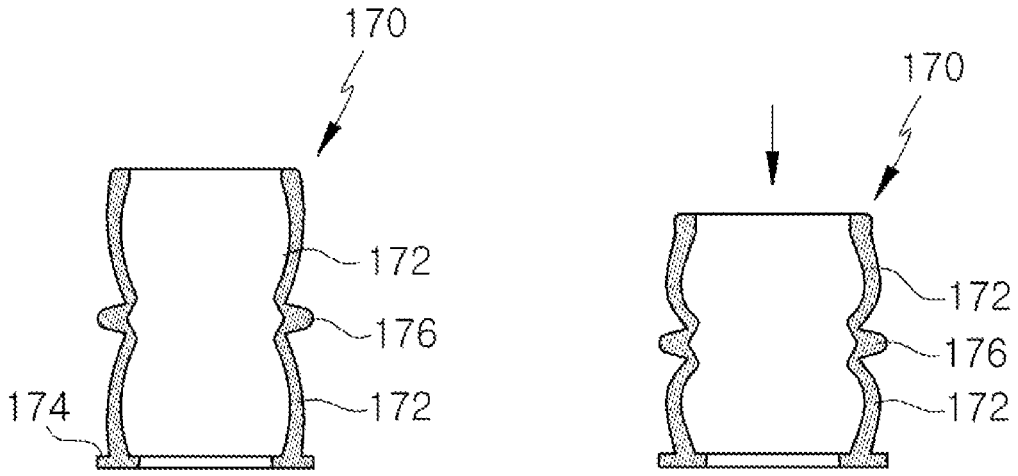
FIG. 11 is a vertical cross-sectional view illustrating the elastic member before and after a pressing action.

FIG. 11 is a vertical cross-sectional view across the center of the elastic member 170, illustrating the elastic member 170 before compression (left drawing) and after compression (right drawing).

Referring to FIG. 11, the elastic member 170 may be positioned between the valve flange 112 and the shoulder flange 144 and may serve to push the valve 110 upward. When an external force is applied, the elastic member 170 may experience an elastic deformation as the deformation portions 172 are compressed, and when the external force is removed, the elastic member 170 may elastically restore its original shape. In this way, the valve 110 may be raised or lowered by the elastic deformation and restoration of the elastic member 170.

In the center of the elastic member 170, there may be formed a center portion 176. The center portion 176 may have an annular shape and may be formed with a relatively greater thickness, so as to undergo little or no deformation even when an external force is applied.

The deformation portions 172 can be formed symmetrically on both ends of the elastic member 170. The deformation portions 172 may be formed with somewhat smaller thicknesses compared to the center portion 176 and may correspond to portions where deformation is relatively easier. Therefore, when an external force is applied, the deformation portions 172 formed above and below in an integrated form at both ends of the center portion 176 may be curved and deformed, allowing a downward movement of the valve 110. When the external force is removed, the deformation portions 172 may be elastically restored, and the valve 110 may be moved upward as a result.

At the lower end of the deformation portion 172 located at the bottom, there may be formed a placement ring 174. The placement ring 174 may rest on the upper surface of the shoulder flange 144 of the pump shoulder 140. The upper end of the deformation portion 172 located at the top may touch the lower surface of the valve flange 112.

The elastic member 170 based on this embodiment may have the non-deforming center portion 176 disposed at the center and the deformation portions 172 disposed on both ends thereof, thus providing the advantage of stable deformation and restoration. It is possible to fabricate the elastic member 170 and the pump shoulder 140 in an integrated form using the same or different materials.

Although the cosmetic container 200 based on this embodiment is illustrated as including a body piston 260 and not including a tube (not shown) on the pump 100, a cosmetic container based on another embodiment of the invention can include a tube and not include a body piston 260.

In a cosmetic container 200 based on this embodiment, the nozzle 210, body shoulder 220, body 250, body piston 260, and pump 100 can all be fabricated from the same plastic resin, thus providing the advantage of easy recycling.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A cosmetic container comprising:

a body having an interior space formed therein for holding a content;

a body shoulder coupled to an upper part of the body; and a pump coupled to an upper part of the body shoulder, wherein the body shoulder comprises an outer periphery member, an inner periphery member, a placement step, and a pump support, the outer periphery member being inserted into the body, the inner periphery member being positioned on an inside of the outer periphery member, the placement step being formed on an upper part of the inner periphery member, the pump support protruding downward from the placement step and having the pump inserted through an inside thereof, wherein the pump comprises a housing inserted through the pump support, and a housing flange configured to rest on the placement step is formed on an outer perimeter of the housing, wherein the body shoulder further comprises a bottom surface, a reinforcing member protrudes from the bottom surface, and the reinforcing member is connected with the inner periphery member.

2. The cosmetic container of claim 1, wherein an outer step is formed on the outer periphery member, the outer step having an upper end of the body inserted therein, and a detent protrusion is formed on an inner perimeter of the pump support, the detent protrusion having an outer perimeter of the housing inserted therethrough.

3. The cosmetic container of claim 2, wherein a disconnect portion is formed in the detent protrusion.

4. The cosmetic container of claim 1, wherein a disconnect portion is formed between the reinforcing member and an inner perimeter of the outer periphery member.

5. The cosmetic container of claim 1, wherein a gap is formed between the inner periphery member and the pump support.

6. The cosmetic container of claim 1, wherein the outer periphery member comprises an inner step formed on an inner perimeter thereof, and the inner step has a downwardly inclining sloped surface.

7. A cosmetic container comprising:

a body having an interior space formed therein for holding a content;

a body shoulder coupled to an upper part of the body; and a pump coupled to an upper part of the body shoulder, wherein the body shoulder comprises an outer periphery member, an inner periphery member, a placement step, and a pump support, the outer periphery member being inserted into the body, the inner periphery member being positioned on an inside of the outer periphery member, the placement step being formed on an upper part of the inner periphery member, the pump support being extended downward from an end of the placement step and having the pump inserted through an inside thereof, wherein the pump comprises a housing inserted through the pump support, and a housing flange configured to rest on the placement step is formed on an outer perimeter of the housing, wherein the pump support has a hollow cylindrical shape.

8. The cosmetic container of claim 7, wherein an outer step is formed on the outer periphery member, the outer step having an upper end of the body inserted therein, and a detent protrusion is formed on an inner perimeter of the pump support, the detent protrusion having an outer perimeter of the housing inserted therethrough.

9. The cosmetic container of claim 8, wherein a disconnect portion is formed in the detent protrusion.

10. The cosmetic container of claim 7, wherein the body shoulder further comprises a bottom surface, a reinforcing member protrudes from the bottom surface, and the reinforcing member is connected with the inner periphery member.

11. The cosmetic container of claim 10, wherein a disconnect portion is formed between the reinforcing member and an inner perimeter of the outer periphery member.

12. The cosmetic container of claim 7, wherein a gap is formed between the inner periphery member and the pump support.

13. The cosmetic container of claim 7, wherein the outer periphery member comprises an inner step formed on an inner perimeter thereof, and the inner step has a downwardly inclining sloped surface.

* * * * *